US005553891A

United States Patent [19]

Ong

[11] Patent Number: 5,553,891

[45] Date of Patent: Sep. 10, 1996

[54] DOCUMENT COVER

[76] Inventor: Bon S. Ong, P.O. Box 4247, Torrance, Calif. 90510

[21] Appl. No.: 297,371

[22] Filed: Aug. 29, 1994

[51] Int. Cl.[6] ..... B42D 17/00

[52] U.S. Cl. ..... 281/43

[58] Field of Search ..... 281/43, 47, 15.1, 281/21.1, 28, 29, 36, 51

[56] References Cited

U.S. PATENT DOCUMENTS

| | | | |
|---|---|---|---|
| 2,960,090 | 11/1960 | Shugant | 281/47 |
| 4,138,143 | 2/1979 | Lawes | 281/36 |
| 4,255,065 | 3/1981 | Errichiello | 281/36 X |
| 4,624,480 | 11/1986 | Mammalen et al. | 281/47 X |
| 5,197,762 | 3/1993 | Abramov . | |

FOREIGN PATENT DOCUMENTS

| | | | |
|---|---|---|---|
| 2221922 | 10/1974 | France | 281/47 |
| 557751 | 1/1975 | Switzerland | 281/47 |

OTHER PUBLICATIONS

Magazine Holder sold by Newell Office Products Group.
File–Bar Catalogue Hanger sold by FileDirect!.
Peek–A–Book Magazine Binder sold by The Angler's Roslyn Group Ltd.

*Primary Examiner*—Willmon Fridie, Jr.
*Attorney, Agent, or Firm*—Charles H. Thomas

[57] ABSTRACT

A holder for a multipage document employs a stiff, flat, thin, elongated suspension strip which defines a narrow, elongated document slot therewithin. The document slot is of a size to receive therethrough a substantial number of pages of the multipage document. The pages of the document thereby hang in two substantially equal sections from both sides of the strip. A jacket is provided to form a pair of opposing covers that enclose the document therebetween. The jacket is secured to the suspension strip by a clamp, adhesive, fasteners extending therethrough, or any other convenient means. The holder may be provided with hooks at its opposite ends for engaging the rails of a hanging file frame in a file drawer, or a hook for hanging the document from a peg or some other support. The hooks may be mounted for longitudinally reciprocal movement relative to the suspension strip. The jacket is optionally provided with one or more pockets.

18 Claims, 7 Drawing Sheets

DOCUMENT COVER

BACKGROUND OF THE INVENTION

1. Field of the Invention

The present invention relates to a combination document cover and holder for protecting a document while suspending it from a support.

2. Description of the Prior Art

Various types of document holders have been devised for suspending publications, such as magazines, catalogues, newspapers, tabloids, reports, booklets, and other soft covered publications and other documents from supports. Such soft covered documents are often suspended from supports, rather than supported from beneath, due to the lack of any inherent sturdiness in the structure of documents of this type. That is, for example, if soft covered publications or other documents ace placed upon a shelf or in a file box, they inevitably collapse and fall to the surface upon which the are supported the moment lateral support is removed from either side. Thus, it is quite difficult to maintain a file of such soft covered documents in an orderly array, since such documents, when arranged side by side, immediately collapse laterally if any one of the documents in a file is removed or if an end lateral support is withdrawn.

The lateral collapse of such documents makes it very difficult to locate the proper position for reinsertion of a document into any particular order once a document that has been withdrawn is to be replaced. Similarly, soft covered documents cannot be successfully stored in the pockets of hanging file folders since they collapse and crumple to the bottom of a hanging file unless the hanging file folders are maintained packed closely together to maintain lateral support at all times.

Various types of hangers have been devised for suspending soft covered documents. U.S. Pat. No. 5,197,762 describes a booklet and document filing device by means of which soft covered booklets and other multipage documents can be suspended in a hanging file system. Another such device is sold as the File-Bar catalogue hanger by FileDirect located in Del Mar, Calif. A magazine holder designed for storing magazines in a standard three-ring binder is sold by Newell Office Products Group located in Madison, Wis. However, the prior document hangers which have heretofore been available have failed to provide the documents to be stored with any kind of protection. Consequently, when such conventional devices are utilized to store soft covered multipage documents the outermost pages of such documents are quite likely to become torn or crumpled. This can easily occur when the hanger bearing the document is dropped onto the rails of a hanging file. The outermost pages of the document are quite likely to become snagged and torn or wrinkled by interference from adjacent hangers.

SUMMARY OF THE INVENTION

One object of the present invention is to provide a holder for soft covered, multipage documents which not only provides a means for suspending such documents in a file or otherwise, but which also provides protection to prevent the pages of such documents from becoming torn, crumpled, or wrinkled. Unlike conventional hangers the holder of the present invention incorporates a pair of covers, both front and back, which shield and protect the pages of the document. The covers are formed by a jacket that is employed in conjunction with a thin, stiff, flat, elongated member that is used to suspend the multipage documents.

Another object of the invention is to provide a holder for soft, multipage documents which provides a means for suspending such documents from a support while protecting them from damage and which is also easy and economical to manufacture. Although the holder of the invention may be constructed from a wide range of inexpensive materials, the preferred embodiments of the invention are fabricated primarily from plastic. The two major components of the holder are the suspension bar and the jacket. The suspension bar may be formed as a thin, stiff, flat, elongated member, preferably stamped or molded from plastic sheet stock. The jacket is preferably formed from a single sheet of more flexible plastic material. Mylar plastic may be employed, for example. The thickness of the sheet material used in the fabrication of the jacket may vary widely, but preferably is between about 5 and 30 mils in thickness.

In one broad aspect the invention may be defined as a protective holder for a document having a plurality of pages comprising a suspension bar formed as an elongated strip of flat, thin, stiff material and defining therethrough an elongated document slot bounded about its entire perimeter by the stiff material. The slot is of a configuration suitable for receiving some of the pages of the document therethrough such that those pages reside on one side of the strip and the remainder of the pages of the documents reside on the other side of the strip. The holder also includes a casing or jacket that forms a pair of enclosing covers disposed about the strip and about the document. The casing or jacket is secured to the strip so that the enclosing covers reside on opposite sides of the document. The covers thereby protect the outermost pages of the document, unlike convention suspension-type holders.

In another broad aspect the invention may be described as a holder for a multipage document comprising a stiff, flat, thin, elongated suspension strip having longitudinally opposite ends and opposite flat sides. The suspension strip defines therewithin and therethrough a narrow, elongated document slot of a size that receives therethrough a substantial number of the pages of the document. The document slot receives these pages so that they project from one of the sides of the strip while the remaining pages of the document project from the other side of the strip. A jacket or casing is secured to the suspension strip and is disposed about both the suspension strip and the document. The jacket has a pair of opposing covers that enclose the document therebetween.

In still another broad aspect the invention may be considered to be the combination of a soft document, an elongated suspension member, and a jacket. The soft document has a plurality of pages. The suspension member is a thin, stiff, flat, elongated structure that defines an elongated, linear document slot therewithin. The document slot receives therethrough some of the pages of the document such that the plurality of pages of the soft document are split into two sections. These two sections are disposed on opposite sides of the suspension member. The jacket is fastened to the elongated member and forms a pair of covers that are disposed on opposite sides of the elongated member and on opposite sides of the pages of the document. The covers thereby enclose the document therewithin.

The invention may be described with greater clarity and particularity with reference to the accompanying drawings.

DESCRIPTION OF THE EMBODIMENTS

Figure 1:
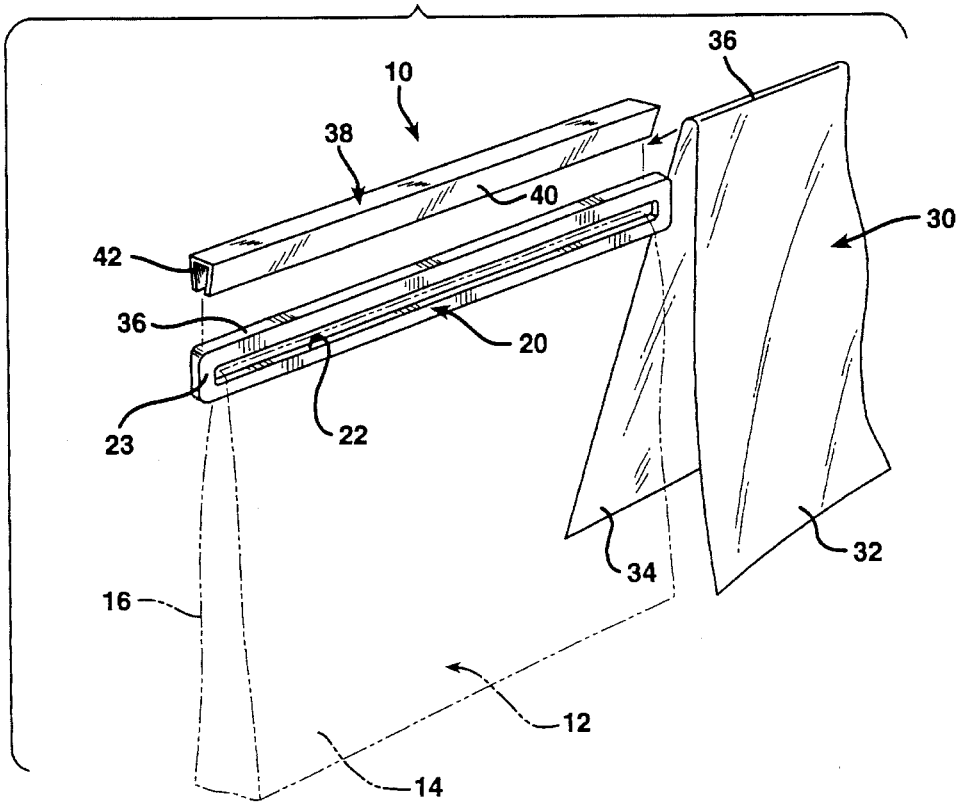
FIG. 1 is a perspective, exploded view showing one preferred embodiment of the combination according to the invention.
Figure 2:
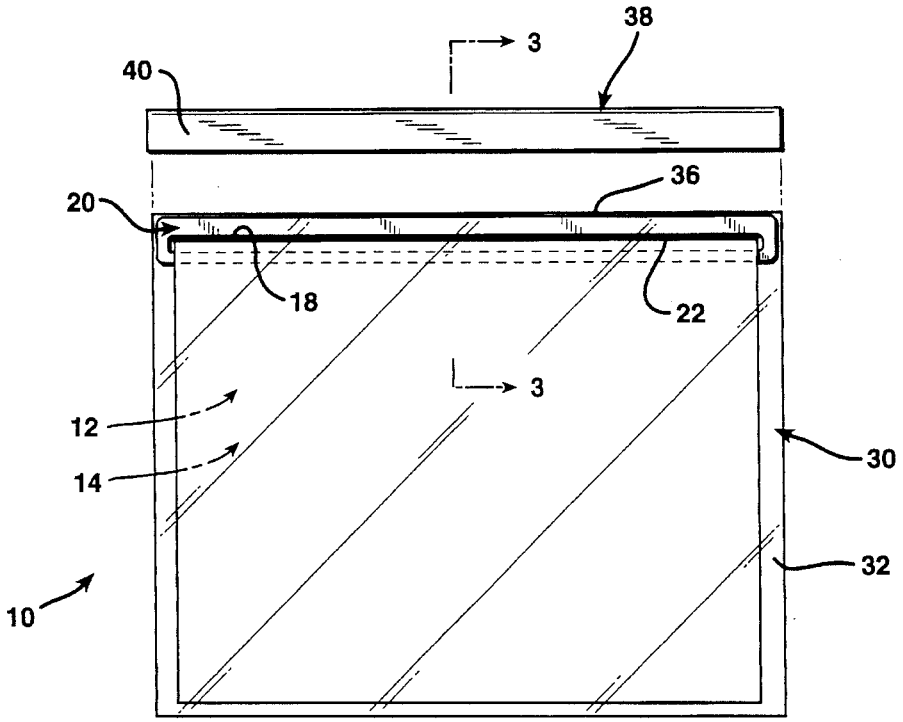
FIG. 2 is a side elevational view of the embodiment of FIG. 1.
Figure 3:
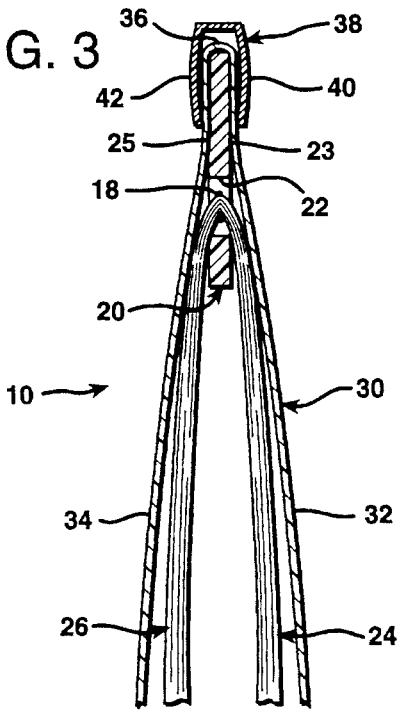
FIG. 3 is transverse sectional detail of the fully assembled combination taken along the lines 3—3 of FIG. 2.

FIG. 1 illustrates a combination according to the invention indicated generally at 10. The embodiment depicted in FIGS. 1–3 is formed of a soft document indicated at 12 and depicted in phantom in FIG. 1. In the simplest embodiment the document 12 may include as few as only a front page 14 and a back page 16. The document 12 may be formed of a single sheet of flexible material, such as paper, folded at its center along the fold line 18 to form the front page 14 and the back page 16. Alternatively, the combination 10 may include a great multiplicity of pages in between the front and back pages 14 and 16. The term "soft document" as used herein means that the document 12 is not self-supporting when placed upright atop a flat, horizontal support such that any of the edges of any of the pages reside in contact with the support, in contradistinction to a disposition of the document 12 with either its front page 14 or its back page 16 lying flat in contact throughout with the horizontal support. The pages of the document 12 may either be bound together along their common edges by glue, staples, or other means. Alternatively, or in addition, the pages may be formed by one or more sheets of a flexible material, such as paper, folded together along a fold line 18, as depicted in the embodiment of FIG. 1.

In addition to the soft document 12, the combination 10 is also comprised of a thin, stiff, flat, elongated suspension member 20, which may be formed of plastic, wood, metal, or any other material that is considerably stiffer than the soft document 12. The elongated suspension member 20 has opposing flat sides 23 and 25 and defines an elongated linear document slot 22 therewithin. The slot 22 extends entirely through the thickness of the member 20 between the flat sides 23 and 25 thereof. The slot 22 is bounded about its entire perimeter by the structure of the material forming the suspension member 20. That is, the slot 22 is an enclosed slot and is not open at either end. Its perimeter lies entirely within the structure of the suspension member 20.

The size of the slot 22 is selected so that the slot 22 receives therethrough a substantial number of the pages of the document 12. The slot 22 receives therethrough at least the back page 16, and preferably half of the pages of the entire document 12. The pages of the document 12 are thereby split into two sections 24 and 26, shown in FIG. 3. The sections 24 and 26 preferably have an equal of number of pages, whereby the innermost pages residing in contact with the structure of the suspension member 20 on the opposite sides 23 and 25 thereof are formed by different portions of the same folded sheet. This facilitates the insertion of the pages through the slot 22.

The combination 10 is also comprised of a jacket or casing 30. In the embodiment of FIGS. 1–4 the jacket 30 has a pair of covers 32 and 34. The covers 32 and 34 are disposed on opposite sides of the elongated support member 20 and on opposite sides of the pages of the document 12 so as to enclose the document 12 therewithin, as best illustrated in FIG. 3.

The jacket 30 may be formed of a single, rectangular sheet of transparent plastic, such as Mylar plastic, and draped over the top edge 36 of the suspension strip 20. The jacket 30 may be secured to the suspension strip 20 in a number of different ways. In the embodiment illustrated in FIGS. 1–4 the combination 10 is additionally comprised of an elongated, generally U-shaped clasp 38 of uniform cross section throughout. The clasp 38 is configured as a stiff, resilient channel-shaped clamp having opposing legs 40 and 42. The legs 40 and 42 of the clamp 38 span and grip the jacket or casing 30 from opposite sides thereof as shown in FIG. 3. The legs 40 and 42 of the clamp 38 thereby hold the jacket 30 in position on the suspension strip 20 through the force of friction.

Figure 5:
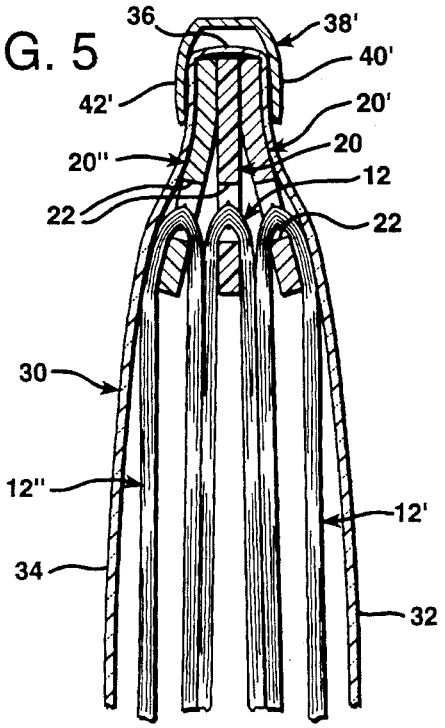
FIG. 5 is a transverse sectional detail of an alternative embodiment to that depicted in FIGS. 1–4.
Figure 4:
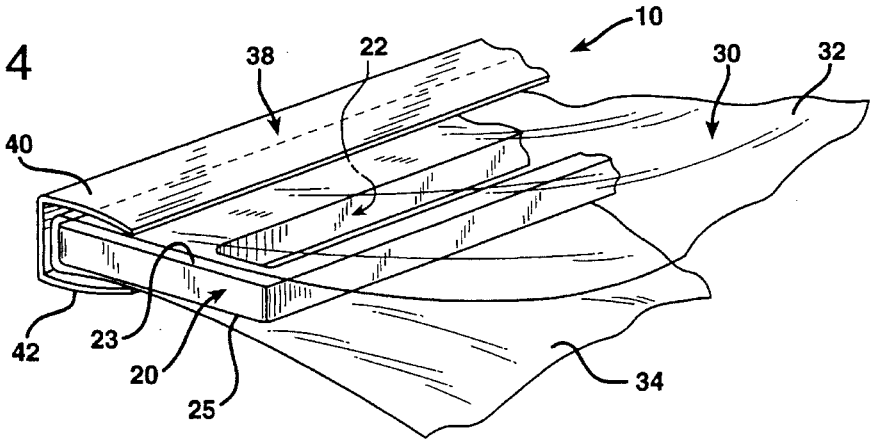
FIG. 4 is a perspective detail of a portion of the document holder of FIGS. 1–3.

The combination 10 depicted in FIGS. 1–4 includes only a single document 12 and a single suspension member 20. In some cases it may be desirable to enclose a plurality of documents 12, 12' and 12" hung on their respective elongated suspension members 20, 20', and 20", in the manner depicted in FIG. 5. In this way a single jacket 30 can be employed to protect the pages of a plurality of documents 12, 12', and 12". All of the elongated members 20, 20', and 20" are identical to each other and are of the type depicted in FIGS. 1–4. The elongated members 20, 20', and 20" are held side by side within the jacket 30 that in turn is held by the clamp or clasp 38'. The clasp 38' is very similar to the clasp 38, but is constructed with a slightly wider web or spine from which the legs 40' and 42' project so as to accommodate the increased aggregate thickness of the several elongated members 20, 20', and 20" as shown.

Figure 6:
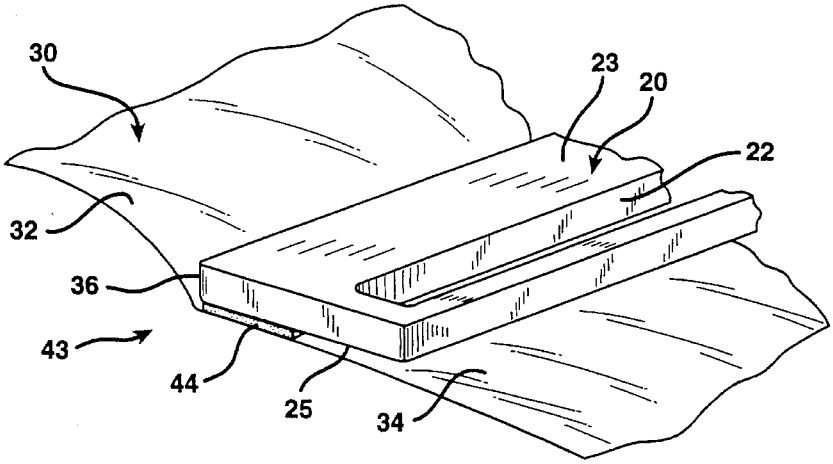
FIG. 6 is a perspective detail of a portion of another alternative embodiment of the document holder of the invention.

FIG. 6 illustrates an alternative embodiment of the combination of the invention employing a document holder 43 in which the jacket 30 is fastened to the slotted, elongated, support member 20 by a layer of adhesive indicated at 44. The jacket 30 may be attached to the slotted suspension strip 20 either prior to or subsequent to insertion of some of the pages of the document 12 through the document slot 22. As shown in FIG. 6, the layer of adhesive 44 may be laid down transversely across the width of the jacket 30 just to one side of the fold line thereof that forms the demarcation between the covers 32 and 34. The portion of the side 25 of the suspension member 20 immediately above the document slot 22 is then pressed against the adhesive layer 44. The jacket 30 is thereby fastened to the suspension member 20 by the linear adhesive layer 44. The cover 32 of the jacket 30 may thereupon be folded over the top edge 36 of the suspension member 20 and down into contact with the opposite flat side 23 thereof.

Figure 7:
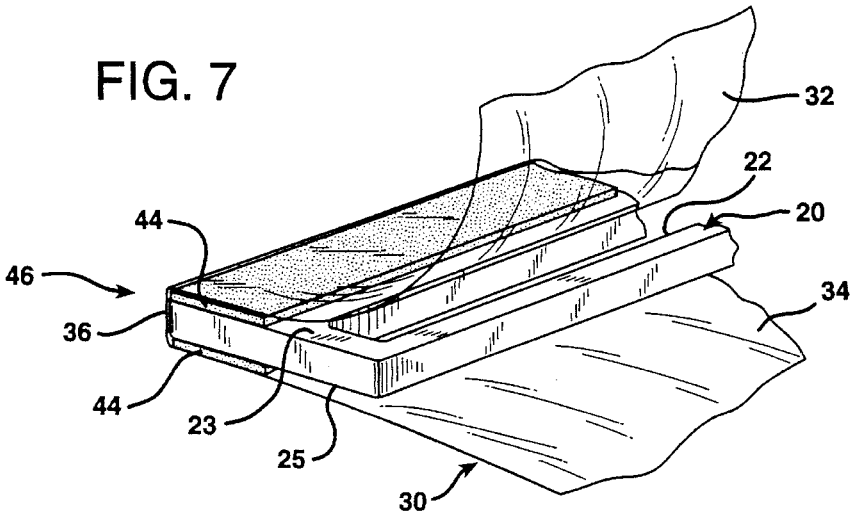
FIG. 7 is a perspective detail showing another alternative embodiment to that depicted in FIG. 6.

The holder 46 depicted in FIG. 7 is similar in many respects to the holder 43 shown in FIG. 6. The holder 46 differs from the holder 43 in that two layers of adhesive 44 are employed, one on each of the flat sides 23 and 25 of the suspension member 20. The adhesive layers 44 ace applied transversely across the width of the jacket 30 along the inside margins of the covers 32 and 34 proximate the center fold line therebetween and spaced apart only a short distance sufficient to accommodate the thickness of the top edge 36 of the suspension member 20. The inside margins of the covers 32 and 34 are thereupon pressed against the flat sides 23 and 25, respectively, of the suspension member 20. The jacket 30 is thereby securely fastened to the suspension member 20 by the double bands of adhesive 44 as shown.

Figure 8:
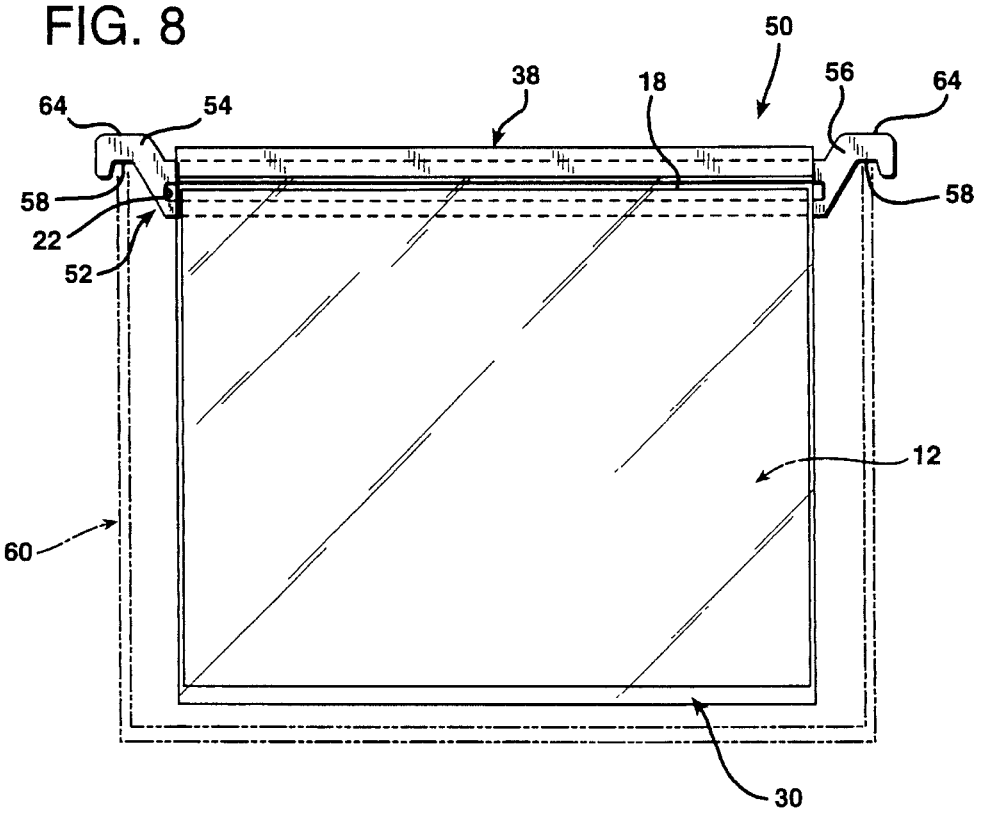
FIG. 8 is a front elevational view illustrating another alternative embodiment of the invention.

FIG. 8 illustrates a combination 50 according to the invention in which an elongated, slotted support member or suspension strip 52 supports a document 12 in the manner previously described. The central portion of the suspension strip 52 is similar to the suspension strip 20 in construction. However, the ends of the suspension member 52 project lengthwise in both of two opposing directions beyond the width of the jacket 30 and terminate in a pair of hooks 54 and 56, each having a gooseneck configuration. The hooks 54 and 56 project away from the document 12 and define concave recesses 58 that face in directions oriented perpendicular to the alignment of the elongated document slot 22 in the member 52.

Figure 9:
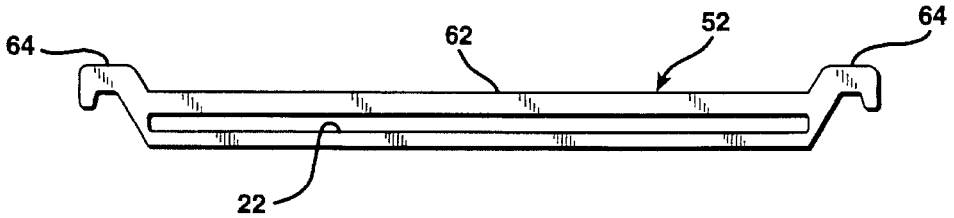
FIG. 9 is a front elevational view showing in isolation the suspension member employed in the embodiment of FIG. 8.

The elongated suspension strip 52 is illustrated in isolation in FIG. 9. So as to fit onto conventional hanging file folder frames the distance between the concave recesses 58 is preferably about 11⅞ inches. The overall length of the suspension strip 52 from the outboard tip of the hook 54 to the outboard tip of the hook 56 is preferably about 12¾ inches. The concave recess or undersurfaces 58 of the hooks 54 and 56 each span a distance suitable for supporting the combination 50 on the elevated support rails of a conventional hanging file 60, which is indicated in phantom in FIG. 8. Each of the recesses 58 for riding atop the rails of a hanging file fold frame is therefore preferably ¼ of an inch in width.

The construction of the suspension strip 52 has another unique feature not heretofore described. Specifically, because the hooks 54 and 56 project upwardly and away from the document 12, the top edge 62 extending along the intermediate, elongated central region of the suspension member 52 between the hooks 54 and 56 is at a level lower than the rod surfaces 64 of the hooks 54 and 56. Specifically, the top edge 62 of the central region of the suspension strip 52 is preferably about ⅛ of an inch below the top edges 64 of the hooks 54 and 56. By constructing the suspension member 52 in this manner, a relatively thick document, such as a catalogue, can be supported atop the edge 62 of the suspension strip 52. Thus, the suspension member 52 is able to support a relatively thick catalogue by allowing one half the pages to hang from one side of the suspension 52 and the other half to hang on the other side of the suspension strip 52, with the weight of the catalogue being carried along the upper edge 62 of the suspension strip 52.

Alternatively, some of the pages of a thinner document can be threaded through the slot 22 so that the document will hang therefrom in the manner previously described. In either event the holder 50 includes a jacket 30 that envelopes the suspension strip 52 and a document position thereon in the manner previously described. The jacket 30 may be fastened to the suspension strip 52 using a clasp 38 of the type described in conjunction with embodiment of FIGS. 1–3 as illustrated in FIG. 8.

Figure 10:
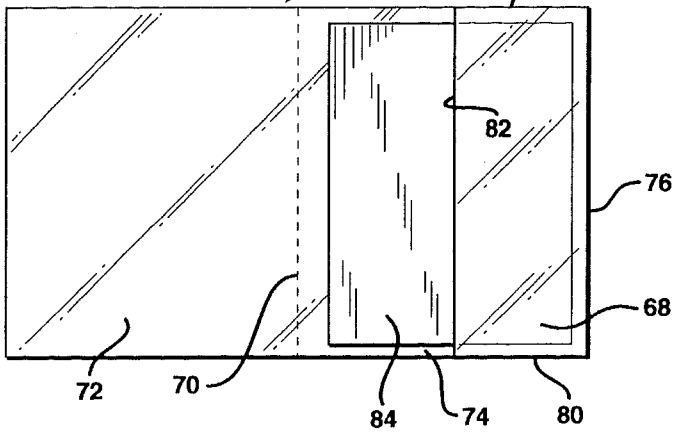
FIG. 10 is a plan view showing one embodiment of a jacket of the holder of the invention in isolation.

The jacket of the invention also lends itself to different variations in construction. FIG. 10 illustrates a jacket 66 that is equipped with a pocket 68. The jacket 66 is formed of a single, rectangular sheet of Mylar plastic. The jacket 66 is designed to be folded along the fold line 70 illustrated in FIG. 10 so as to define covers 72 and 74 of equal dimensions. The sheet of material forming the jacket 66 is likewise folded at one end along the line 76, so that a panel thereof extends back toward the fold line 70 on the inside surface of the jacket 66. The folded panel is heat sealed along its upper and lower edges 78 and 80 but is not sealed to the cover 74 along its terminal, transverse edge 82. Thus, the folded panel flap is closed along its boundary formed by the fold line 76 and alone its upper and lower boundaries 78 and 80. Since the edge 82 thereof is not fastened to the underlying cover 74, the panel thereby forms the pocket 68 which is adapted to receive materials inserted therein, such as the card 84 illustrated in FIG. 10.

Figure 11:
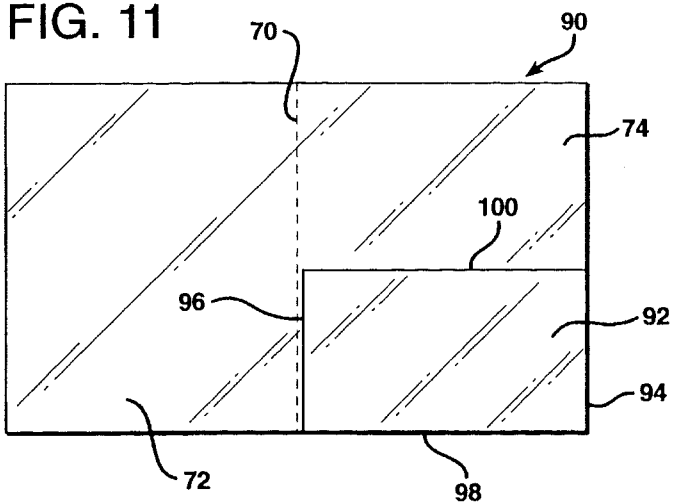
FIG. 11 is a plan view showing another alternative embodiment of a jacket for a holder according to the invention.

FIG. 11 illustrates another embodiment of the invention employing a jacket 90 of different construction. Like the jacket 66, the jacket 90 has a fold 70 that delineates the front and back covers 72 and 74 from each other in the manner previously described. The jacket 90 is formed of a single sheet of transparent, durable covering material, but not from a blank having a rectangular configuration. Rather, at one end of the sheet of material forming the jacket 90 there is a longitudinally extending panel 92. The panel 92 is folded back along the fold line 94 toward the fold line 70. The edge 96 of the panel 92 is heat sealed to the underlying cover 74. The panel 92 is likewise heat sealed to the underlying cover 74 along its lower edge 98. The upper edge 100 of the panel 92 is not attached to the underlying cover 74 in that intermediate area between the fold line 94 and heat sealed edge 96. Therefore, papers and other objects can be inserted into the pocket formed by the panel flap 92 by lifting the unsealed edge 100 of the panel flap 92 to gain access to the pocket formed between the panel 92 and the underlying cover 74.

Figure 12:
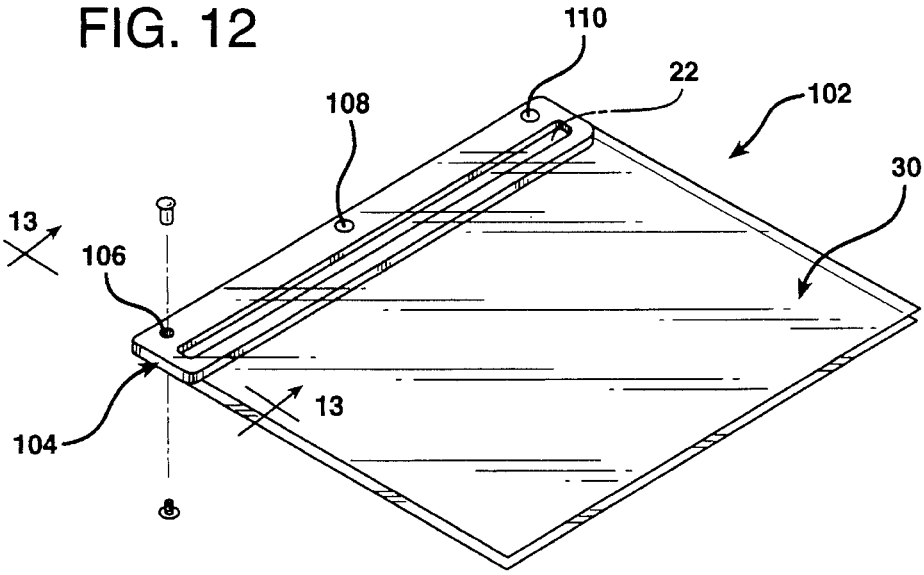
FIG. 12 is a perspective view, partially exploded, showing another alternative embodiment of a holder according to the invention.
Figure 13:
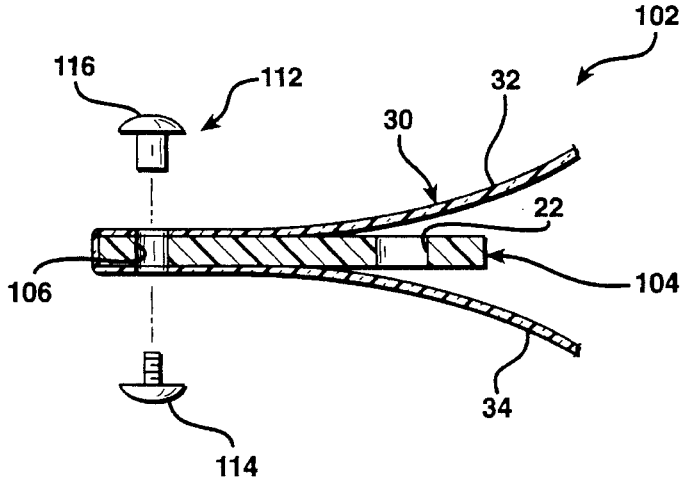
FIG. 13 is a transverse sectional detail taken along the lines 13—13 of FIG. 12.

FIGS. 12 and 13 illustrate another embodiment of the invention. The combination 102 shown in FIG. 12 includes a jacket 30 and a suspension strip 104. The suspension strip 104 is very similar to the suspension strip 20 in the embodiment of the invention depicted in FIGS. 1–4. That is, the suspension strip 104 includes an elongated slot 22 defined entirely within the slab of material forming the suspension strip 104. However, in addition to the document slot 22 the suspension strip 104 is also provided with a plurality of small fastener openings 106, 108, and 110. The fastener openings 106, 108, and 110 extend completely through the structure of the suspension strip 104. Also, coaxial circular openings are defined through the structure of the covers 32 and 34 of the jacket 30, as shown in FIG. 12. These openings in the covers 32 and 34 and the corresponding openings in the suspension strip 104 allow the jacket 30 to be secured to the suspension strip 104 by means of fasteners indicated generally at 112.

Each of the fasteners 112 has a male element 114 and a female element 116. The male element 114 has an externally threaded shank that projects from a substantially button-shaped head. The female element 116 likewise has a button-shaped head and is provided with a cylindrical, annular socket that is internally tapped to threadably engage the shank of the male fastening element 114.

As illustrated in FIGS. 12 and 13, the female elements 116 are inserted through the circular openings in the cover 32 so that the hollow, cylindrical, annular fastening sockets thereof project into the openings 106, 108, 110 defined in the structure of the suspension strip 104. The threaded shanks of the male fastener elements 114 are inserted through the corresponding openings in the cover 34. The fasteners 112 thereby pass through the jacket 30 and through the fastener openings 106, 108,110 of the suspension strip 104. The male and female elements 114 and 116 are thereupon tightened together to securely fasten the jacket 30 onto the suspension strip 104 to clamp the jacket 30 onto the elongated member forming the suspension strip 104.

Figure 14:
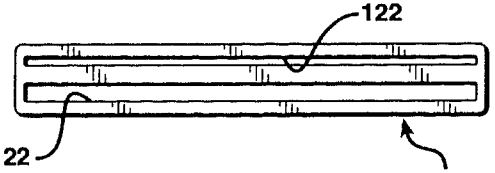
FIG. 14 is a plan view illustrating in isolation a support member of still another embodiment of a holder according the invention.
Figure 15:
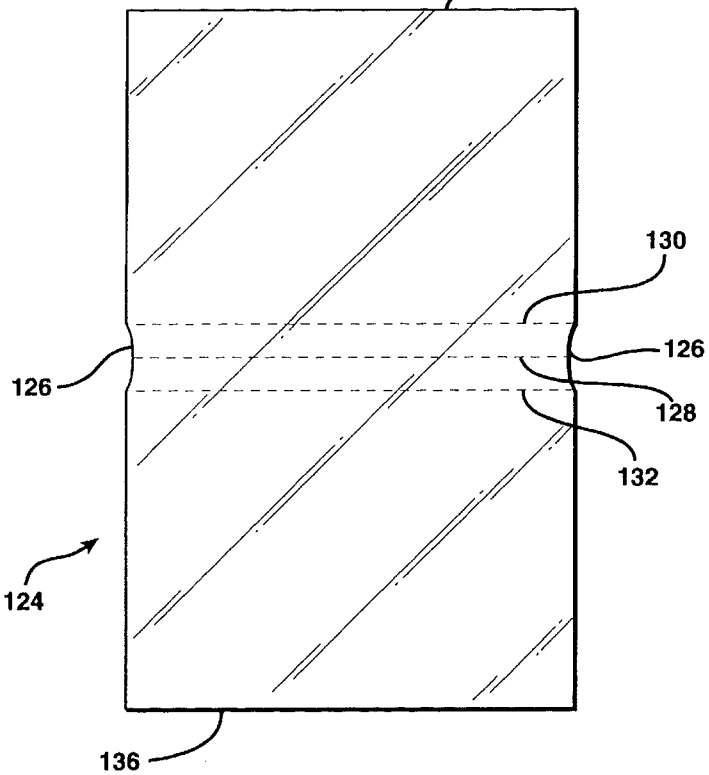
FIG. 15 is a plan view showing in isolation a jacket employed in conjunction with the support member of FIG. 14.
Figure 16:
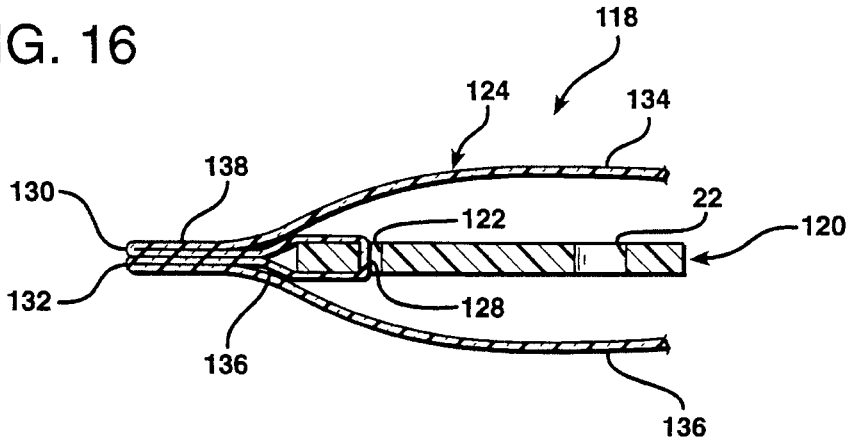
FIG. 16 is a transverse sectional detail showing the manner of interconnection of the support member of FIG. 14 and the jacket of FIG. 15.

FIGS. 14, 15, and 16 illustrate still another embodiment of the holder of the invention, indicated generally at 118. In this embodiment the elongated suspension member 120 is provided with a document slot 22 as in the other embodiments, and also with a second, narrower elongated linear jacket slot 122 that is parallel to and substantially coextensive with the document slot 22. The jacket 124 employed in conjunction with the stiff, flat, elongated member 120 is formed as a single sheet of flexible material, such as Mylar, which is generally rectangular in shape but which has shallow, concave recesses 126 defined at its midsection, as shown in FIG. 15. Due to the recesses 126 the width of the sheet forming the jacket 124 as measured along the central fold line 128 is substantially equal to the length of the jacket slot 122. Elsewhere the jacket 124 broadens slightly so that its width is wider than that of a document to be protected therewithin and uniform as measured along the fold lines 130 and 132 and along its end edges 134 and 136.

To assemble the holder 118 the sheet of flexible material forming the jacket 124 is threaded through the jacket slot 122. Although the sheet of material forming the jacket 124 is stiffer than the pages of a document to be held within the document slot 122, the jacket material is flexible enough to allow an end of the jacket sheet to be worked through the jacket slot 122 until the central folding line 128 resides within the jacket slot 122. The jacket material is then folded along the fold line 128. This forms a loop 136 that extends through the jacket slot 122.

The jacket 124 is also folded back along the fold lines 130 and 132 so that the structure of the jacket material immediately adjacent to the fold lines 130 and 132 is brought into intimate contact in the manner illustrated in FIG. 16. At the fold lines 130 and 132 the sheet of jacket material is doubled back upon itself so that there are four layers of thickness of the jacket material immediately adjacent to the fold lines 130 and 132. When the sheet of jacket material is doubled back upon itself in both directions from the loop 136, the two expansive end portions of it form covers 140 and 142 of the type previously described.

The loop 136 is sealed shut by heat sealing the layers of the structure of the jacket material together immediately adjacent to the fold lines 130 and 132 in the area indicated at 138 in FIG. 16. All four of the layers of thickness of the sheet material forming the jacket 124 are fused together in the region 138. The holder 118 may then be utilized in the same way as the holder depicted in FIGS. 1–4.

Figure 17:
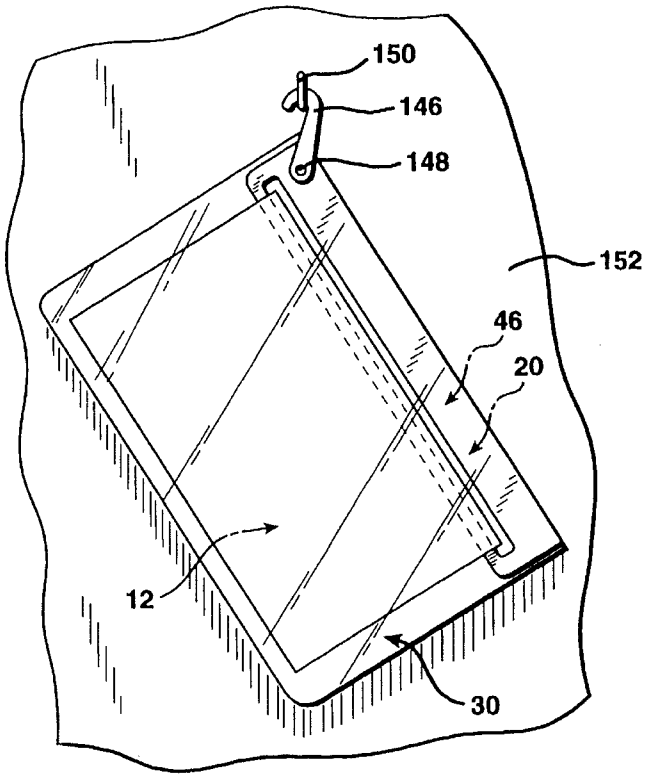
FIG. 17 is a front elevational view of still another embodiment of the combination of the invention.

FIG. 17 illustrates still another embodiment of a combination according to the invention employing the holder 46 depicted in FIG. 7. The holder 46 is shown suspending a document 12 of the type previously described. In addition to the jacket 30, holder 46, and document 12 previously described, the combination of the invention depicted in FIG. 17 also includes a hook 146 secured at one end of the holder 46 by means of an axle pin 148. The hook 146 can thereby rotate relative to the holder 46. The hook 146 is attached to the elongated strip 20 and serves to allow the holder 46 to be suspended from a support, such as a peg or bracket 150 of the type illustrated. The bracket 150 mat project outwardly from an upright vertical wall 152 such as the wall of a waiting room or a bulletin board.

Figure 18:
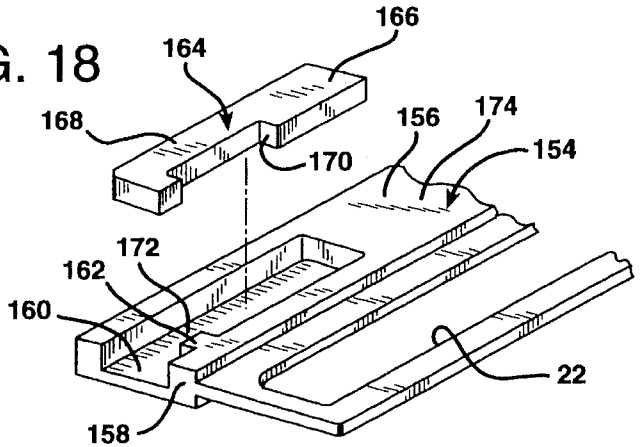
FIG. 18 is an exploded perspective detail of a portion of a suspension member of still another embodiment of a holder according to the invention.
Figure 20:
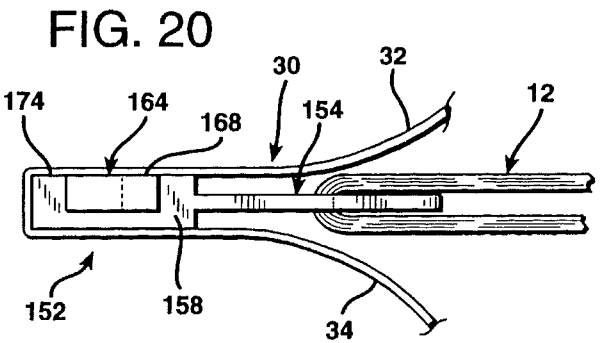
FIG. 20 is a transverse sectional detail taken along the lines 20—20 of FIG. 19.
Figure 19:
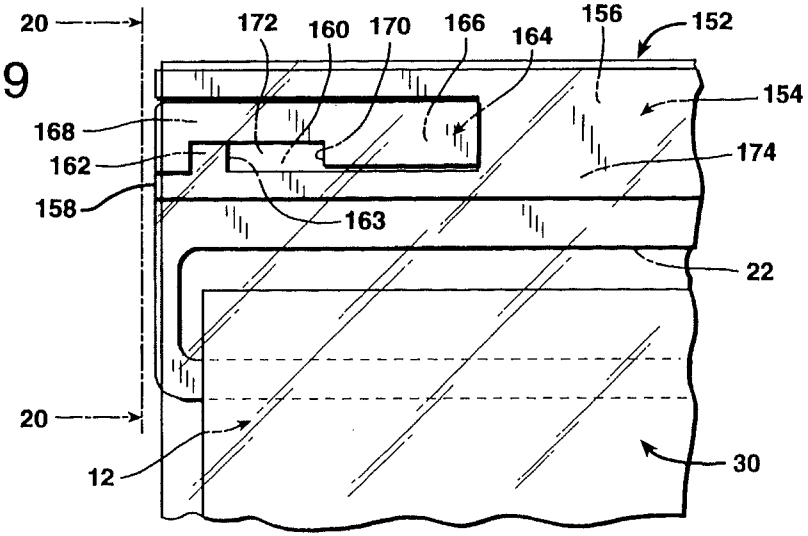
FIG. 19 is a front elevational detail showing a portion of still another embodiment of the combination according to the invention employing the suspension member depicted in FIG. 18 with the slide thereof retracted.

Another embodiment of a holder according to the invention is depicted in FIGS. 18–20. In this embodiment the protective holder 152 of the invention has an elongated, flat strip 154 formed with a pair of opposite ends 156 and a pair of end extremities 158. The ends 156 and end extremities 158 are formed in a mirror image configuration, only one of which is illustrated in FIGS. 18–20. Each of the ends 156 has a concave generally channel-shaped slide cavity 160 formed therein. The slide cavity 160 is aligned parallel to the document slot 22, previously described. The slide cavity 160 is of a generally rectangular configuration and has a uniform cross-sectional width throughout most of its length. The slide cavities 160 are constricted at spaced distances from the end extremities 158 by portions of the structure of the strip 154 which project laterally into the slide cavities 160 near the end extremities 158 to form slide stops 162. The elongated strip 154 is provided with slide cavities 160 and slide stops 162 at both of its opposite ends. Each slide stop 162 has a transverse, inwardly facing abutment face 163, shown in FIG. 19.

The holder 152 is further comprised of a pair of slides 164 of identical construction. Each of these slides 164 is formed with a body portion 166 of generally rectangular configuration which fits and slides smoothly within the wider, interior portions of the slide cavities 160. At its outboard extremity each of the slides 164 narrows in width to form a hook 168 of a size and shade suitable for engaging the rails of a conventional hanging file framework. The hook portions 168 project from the body portions 166 so that an abutment face 170 is formed on each slide 164 at each transition between each wider body section 166 and each narrower hook sections 168 thereof. Each abutment face 170 limits outward movement of the slide 164 relative to the elongated strip 154 when the abutment face 170 of the body portion 166 is brought into interfering relationship with the opposing abutment face 163 of the slide stop 162 at each end of the elongated strip 154.

From FIGS. 18 and 19 it can be seen that the body portions 166 of the slides 164 move reciprocally within the slide cavities 160 and are restrained within the slide cavities 160 by abutting contact with the slide stops 162. Therefore, the hooks 168 can be pulled outwardly away from the center of the elongated strip 154 to engage the rails of a hanging file. When withdrawn from a position depicted in FIG. 19 in this fashion the hooks 168 will project well beyond the end extremities 158 of the elongated strip 154.

As best illustrated in FIGS. 18 and 20, it can be seen that the slide cavities 160 do not extend through the entire thickness of the elongated strip 154, but rather only partially therethrough. Thus, the slide cavities 160 have a floor or wall 172 that provides lateral support to the slide 164 as it moves reciprocally within the slide cavity 160. The slide 164 is laterally retained within the slide cavity 160 from the other side by securement of the cover 32 of the jacket 30 to the upper, exposed surface 174 of the elongated strip 154. The cover 32 may be secured to the upper surface 174 by any of the means previously described and depicted, for example, in FIGS. 3, 6, or 7.

Figure 21:
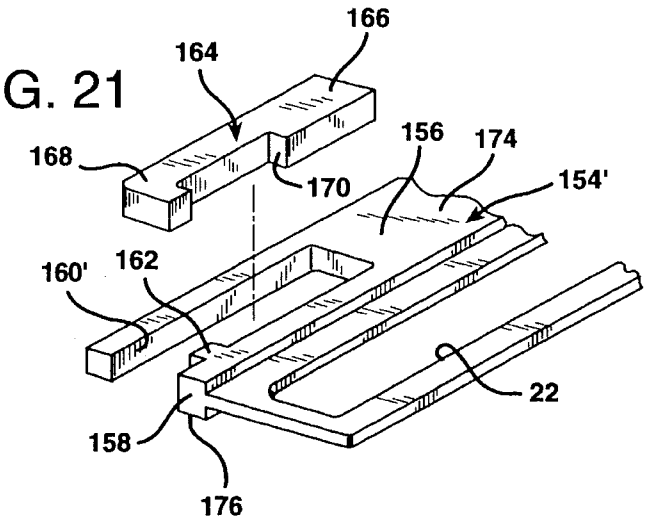
FIG. 21 is an exploded perspective detail of a portion of still another suspension member of a holder according to the invention.
Figure 23:
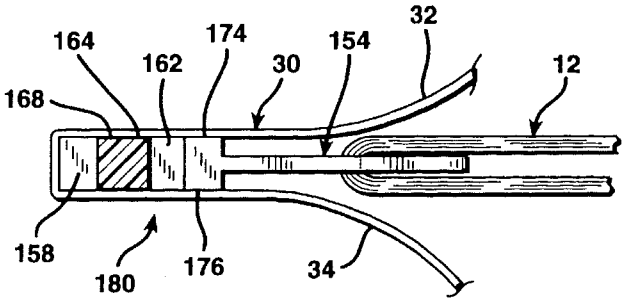
FIG. 23 is a transverse sectional detail taken along the lines 23—23 of FIG. 22.
Figure 22:
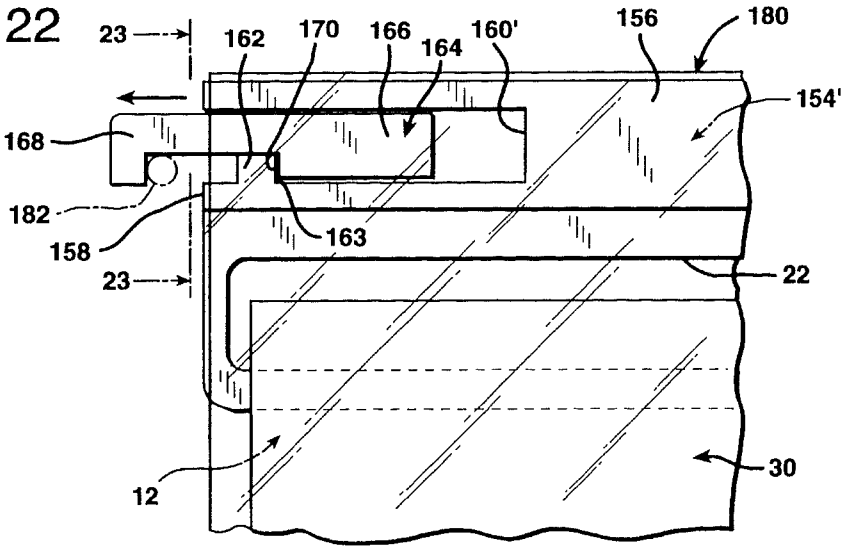
FIG. 22 is a front elevational detail showing a portion of still another embodiment of the combination according to the invention employing the suspension member depicted in FIG. 21 with the slide thereof extended.

FIGS. 21–23 illustrate another embodiment of a protective holder 180 which is quite similar in many respects to the holder 152. Elements and structural features of the holder 180 that are likewise present in the holder 152 are identified by the same reference numbers and function in the same manner described in connection therewith.

The holder 152 differs from the holder 180 in that each slide cavity 160' is formed entirely through the thickness of the structure of the elongated strip 154', rather than only partially therethrough. The cavity 160' extends the entire distance between the opposing, flat surfaces 174 and 176 thereof. As a consequence, it is important for both of the covers 32 and 34 to be securely attached to the outer flat surfaces 174 and 176 of the elongated strip 154' at both ends 156 thereof. The structure of the covers 32 and 34 thereby laterally restrains the slides 164 and holds them in the cavities 160'. The slide cavity 160 in the holder 152 is formed as a concave recess in only the side 174 of the elongated strip member 154. In both of the holders 152 and 180 the slides 164 can be extended from their associated elongated strip 154 or 154' so as to support the holder on a hanging file tail 182, shown in phantom in FIG. 22, or retracted for convenience of storage as shown in FIG. 19.

The holder 152 has the advantage of greater lateral support for the slide 164, as contrasted with the embodiment of FIGS. 21–23. The embodiment of FIGS. 21–23, on the other hand, can employ a thinner elongated strip 154', thereby allowing a greater number of relatively thin documents 12 to be stored in a given hanging file folder drawer as contrasted with the holder 152.

Undoubtedly, numerous variations and modifications of the invention will become readily apparent to those familiar with holders for suspending documents for storage. For example, the jacket can be secured to the elongated strip by any convenient method, such as by heat sealing, fusion, stapling, or the use of some other fastening arrangement. Accordingly, the scope of the invention should not be construed as limited to the specific embodiments depicted and described herein.

I claim:

1. In combination, a soft document having a plurality of pages; a stiff, elongated member defining an elongated linear document slot therewithin that receives therethrough some of said pages of said document such that said plurality of pages are split into two sections disposed on opposite sides of said member; a jacket formed of a single sheet of flexible material folded at its center and draped over said elongated member, and forming a pair of covers that are disposed on opposite sides of said elongated member and on opposite sides of said pages of said document so as to enclose said document therewithin; and a clasp that frictionally grips and holds said jacket therewithin against said elongated member, whereby said jacket is fastened to said elongated member by said clip.

2. A combination according to claim 1 further comprising a plurality of documents and a plurality of elongated members as aforesaid, all held side-by-side within said jacket and said clasp.

3. In combination, a soft document having a plurality of pages; a stiff, elongated member defining an elongated linear document slot therewithin that receives therethrough some of said pages of said document such that said plurality of pages are split into two sections disposed on opposite sides of said member; and a jacket fastened to said elongated member by adhesive and forming a pair of covers that are disposed on opposite sides of said elongated member and on opposite sides of said pages of said document so as to enclose said document therewithin.

4. A combination according to claim 3 further characterized in that said jacket is fastened to said elongated member by adhesive layers between said jacket and said elongated member on both sides of said elongated member.

5. In combination, a soft document having a plurality of pages; a stiff, elongated member defining an elongated linear document slot therewithin that receives therethrough some of said pages of said document such that said plurality of pages are split into two sections disposed on opposite sides of said member; and a jacket fastened to said elongated member and forming a pair of covers that are disposed on opposite sides of said elongated member and on opposite sides of said pages of said document so as to enclose said document therewithin, wherein said elongated member projects lengthwise in both of two opposing directions from said jacket and terminates in a pair of hooks that project away from said document and which define concave recesses that face in directions oriented perpendicular to the alignment of said elongated slot.

6. A combination according to claim 1 wherein at least one of said covers defines a pocket therewithin.

7. In combination, a soft document having a plurality of pages; a stiff, elongated member defining an elongated linear document slot therewithin that receives therethrough some of said pages of said document such that said plurality of pages are split into two sections disposed on opposite sides of said member; and a jacket fastened to said elongated member and forming a pair of covers that are disposed on opposite sides of said elongated member and on opposite sides of said pages of said document so as to enclose said document therewithin, wherein said elongated member also has a plurality of small fastener openings defined therethrough and further comprising fastening means that pass through said jacket and through said fastener openings to clamp said jacket onto said elongated member.

8. In combination, a soft document having a plurality of pages; a stiff, elongated member defining an elongated linear document slot therewithin that receives therethrough some of said pages of said document such that said plurality of pages are split into two sections disposed on opposite sides of said member; and a jacket fastened to said elongated member and forming a pair of covers that are disposed on opposite sides of said elongated member and on opposite sides of said pages of said document so as to enclose said document therewithin, wherein said elongated member is provided with an elongated linear jacket slot extending parallel to said elongated document slot and said jacket is formed as a single sheet of flexible material that is threaded through said jacket slot in said elongated member to form a loop through said jacket slot, and said loop is sealed shut and said sheet of material is doubled back upon itself in both directions from said loop to form said covers as aforesaid.

9. A combination according to claim 1 wherein said elongated member has at least one end that protrudes from within said jacket and further comprising a hook attached to said elongated member at said at least one end thereof to allow said elongated member to be suspended from a support.

10. In combination, a soft document having a plurality of pages; a stiff, elongated member defining an elongated linear document slot therewithin that receives therethrough some of said pages of said document such that said plurality of pages are split into two sections disposed on opposite sides of said member; and a jacket fastened to said elongated member and forming a pair of covers that are disposed on opposite sides of said elongated member and on opposite sides of said pages of said document so as to enclose said document therewithin, wherein said elongated member has opposite ends and is formed with at least one slide cavity therewithin and a pair of slide retainers bounding said at least one slide cavity at said opposite ends of said elongated member, and a pair of slides having outwardly projecting hooks thereon that are engagable with rails of a hanging file and wherein said slides have bodies that travel reciprocally within said at least one slide cavity and which are retained therewithin by said pair of slide retainers.

11. A combination according to claim 10 wherein said at least one slide cavity is formed as a concave recess in one side of said elongated member.

12. A combination according to claim 10 wherein said slide cavity is formed entirely through the thickness of said elongated member.

13. A protective holder for a document having a plurality of pages comprising a suspension bar formed as an elongated strip of stiff material and defining therethrough an elongated document slot bounded About its entire perimeter by said material, said slot being of a configuration suitable for receiving some of said pages of said document therethrough such that some of said pages reside on one side of said strip and the remainder of said pages reside on the other side of said strip, and a casing forming a pair of enclosing covers disposed about said strip and about said document and secured to said strip so that said enclosing covers reside on opposite sides of said document, and a stiff, resilient channel shaped clamp that spans and grips said casing from opposite sides thereof.

14. A protective holder for a document having a plurality of pages comprising a suspension bar formed as an elongated strip of stiff material and defining therethrough an elongated document slot bounded about its entire perimeter by said material, said slot being of a configuration suitable for receiving some of said pages of said document therethrough such that some of said pages reside on one side of said strip and the remainder of said pages reside on the other side of said strip, and a casing forming a pair of enclosing covers disposed about said strip and about said document and secured to said strip so that said enclosing covers reside on opposite sides of said document, wherein said casing is secured to said strip by adhesive.

15. A protective holder for a document having a plurality of pages comprising a suspension bar formed as an elongated strip of stiff material and defining therethrough an elongated document slot bounded about its entire perimeter by said material, said slot being of a configuration suitable for receiving some of said pages of said document therethrough such that some of said pages reside on one side of said strip and the remainder of said pages reside on the other side of said strip, and a casing forming a pair of enclosing covers disposed about said strip and about said document and secured to said strip so that said enclosing covers reside on opposite sides of said document, wherein said casing is secured to said strip by fasteners that extend through said covers and through said strips.

16. A protective holder according to claim 14 further comprising at least one hook attached to said strip to allow said holder to be suspended from a support.

17. A protective holder for a document having a plurality of pages comprising a suspension bar formed as an elongated strip of stiff material and defining therethrough an elongated document slot bounded about its entire perimeter by said material, said slot being of a configuration suitable for receiving some of said pages of said document therethrough such that some of said pages reside on one side of said strip and the remainder of said pages reside on the other side of said strip, and a casing forming a pair of enclosing covers disposed about said strip and about said document and secured to said strip so that said enclosing covers reside on opposite sides of said document, wherein said strip is formed with opposite ends and end extremities thereof, slide cavities aligned parallel to said slot and defined within said strip at said opposite ends thereof and slide stops for each of said slide cavities located at said end extremities of said strip, and slides having bodies that slide reciprocally within said slide cavities and which are retained within said slide cavities by abutting contact with said slide stops, and hooks for engaging rails of a hanging file, wherein said hooks project from said strip beyond said end extremities thereof.

18. A holder for a multipage document comprising a stiff, elongated suspension strip having longitudinally opposite ends and opposite flat sides and defining therewithin and therethrough a narrow, elongated document slot of a size that receives therethrough a substantial number of the pages of said document such that said substantial number of pages project from one of said sides of said strip and the remaining pages of said document project from the other of said sides of said strip and a jacket secured to said suspension strip by adhesive and disposed about both said suspension strip and said document and having a pair of opposing covers that enclose said document therebetween.

* * * * *